US008100393B2

(12) United States Patent
Ray et al.

(10) Patent No.: US 8,100,393 B2
(45) Date of Patent: Jan. 24, 2012

(54) SAWTOOTH JOG FOR MULTI-COPY/MULTI-SET OUTPUT

(75) Inventors: Elton T Ray, Livonia, NY (US); Brian R Pierson, Victor, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/180,570

(22) Filed: Jul. 12, 2011

(65) Prior Publication Data

US 2011/0266739 A1 Nov. 3, 2011

Related U.S. Application Data

(63) Continuation-in-part of application No. 12/697,349, filed on Feb. 1, 2010.

(51) Int. Cl.
*B65H 37/04* (2006.01)

(52) U.S. Cl. ..... 270/58.31; 414/791.2

(58) Field of Classification Search ..... 270/58.31, 270/58.32; 414/791.2, 789.3, 789.5
See application file for complete search history.

(56) References Cited

U.S. PATENT DOCUMENTS

| | | | | |
|---|---|---|---|---|
| 3,205,739 | A * | 9/1965 | Meyer-Jagenberg | 83/23 |
| 4,865,308 | A * | 9/1989 | Krasik | 271/213 |
| 5,007,625 | A | 4/1991 | Kremers et al. | |
| 5,272,511 | A * | 12/1993 | Conrad et al. | 399/382 |
| 5,618,035 | A | 4/1997 | Coombs et al. | |
| 5,848,346 | A * | 12/1998 | Takashiro | 399/404 |
| 5,951,008 | A | 9/1999 | Williams et al. | |
| 6,966,552 | B2 * | 11/2005 | Trovinger et al. | 270/52.17 |
| 2006/0214348 | A1 * | 9/2006 | Blanchard et al. | 270/58.31 |
| 2007/0047975 | A1 * | 3/2007 | Dan | 399/8 |

* cited by examiner

*Primary Examiner* — Patrick Mackey

(57) ABSTRACT

A method of positioning copy or subsets for the easy insertion of tabs thereinto that includes creating a shingled boundary between subsets, with the top sheets of all subsets in the same position, but with the rest of each subset progressively offset so that the last page of the upper subset is significantly offset from the top sheet of the next subset in sawtooth fashion. As a result, the subsets can then be separated from one side more easily and tabs or other pages can be manually inserted with minimal difficulty.

4 Claims, 2 Drawing Sheets

SAWTOOTH JOG FOR MULTI-COPY/MULTI-SET OUTPUT

CROSS-REFERENCE TO RELATED APPLICATIONS

This disclosure is a continuation-in-part of co-pending U.S. application Ser. No. 12/697,349, entitled SAWTOOTH JOG FOR MULTI-COPY/MULTI-SET OUTPUT, filed Feb. 1, 2005 by the same inventors, and claims priority therefrom.

BACKGROUND

1. Field of the Disclosure

The method disclosed herein relates to manipulating multi-copy/multi-set documents. In particular, the disclosed method relates to ease of insertion of pages into multi-copy/multi-set output.

2. Description of Related Art

Stacking apparatus for forming offset stacks of paper is well known. Each stack comprises a plurality of equal sized sheets stacked in registration one on top of the other. A conveyor belt delivers sheets for stacking. After the apparatus forms one stack of sheets against a paper stop, the paper stop is displaced and a second paper stop is moved into position. The second paper stop is offset from the first paper stop. A second stack of sheets forms against the second paper stop. The second stack is offset from the first stack. The back of each stack is defined as the portion of each stack that is near the conveyor belt which delivers sheets which form and comprise the stack. The front of each stack is defined as a portion of each stack that is adjacent to the paper stop or stops which halt the travel of each sheet in the stack after the sheet is conveyed onto the stack.

An apparatus is shown in U.S. Pat. No. 5,007,625 to Henry T. Kremers et al. which regulates offsetting stacks of sheets reproduced from at least one original document. In one mode, successive stacks of uncollated sheet are offset from one another, and in another mode, offsetting of stacks of collated copy sheets is inhibited. In U.S. Pat. No. 5,618,035 a self-contained offset stacker tray assembly is operable in conjunction with the sheet output of a host printer to receive sheets from the host printer and deposit the sheets in offset sets. Similarly, an offsetting paper stacking device is shown in U.S. Pat. No. 5,951,008 that automatically stacks sheets of paper into groups which are offset from each other. The paper is stacked in one pile; however, within that pile there are groups of sheets that are stacked at a sideways offset to the group immediately above and below. Accordingly, every other group of sheets of paper will be in line with each other and each adjacent group will be offset from each other. A drawback to sheet offset stackers of this type is that east insertion of pages into the offset stacks is not facilitated.

Some printers allow easy manual separation of copies or subsets in a single job by alternating the position of the printed output a few millimeters back and forth between each copy or subset. This allows a person to grab the edge of a copy or subset with their finger and separate it from the rest of a stack of printed output. If one looks at the edge of a stack of printed copies or subsets jogged in this fashion, a square wave pattern will be seen. This is suitable for manually separating copies or subsets in a job, but if one wanted to insert pages, it is more awkward. The boundary between each copy or set is in a different position every time.

BRIEF SUMMARY

Accordingly, in answer to this problem and disclosed herein is a method of positioning copy or subsets for the easy insertion of pages thereinto that includes creating a shingled boundary between subsets of a single job, with the top sheets of all subsets in the same position, but with the rest of each subset progressively offset so that the last page of the upper subset is significantly offset from the top sheet of the next subset in sawtooth fashion. Thus, the subsets can then be separated from one side more easily and pages can be manually inserted with minimal difficulty.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
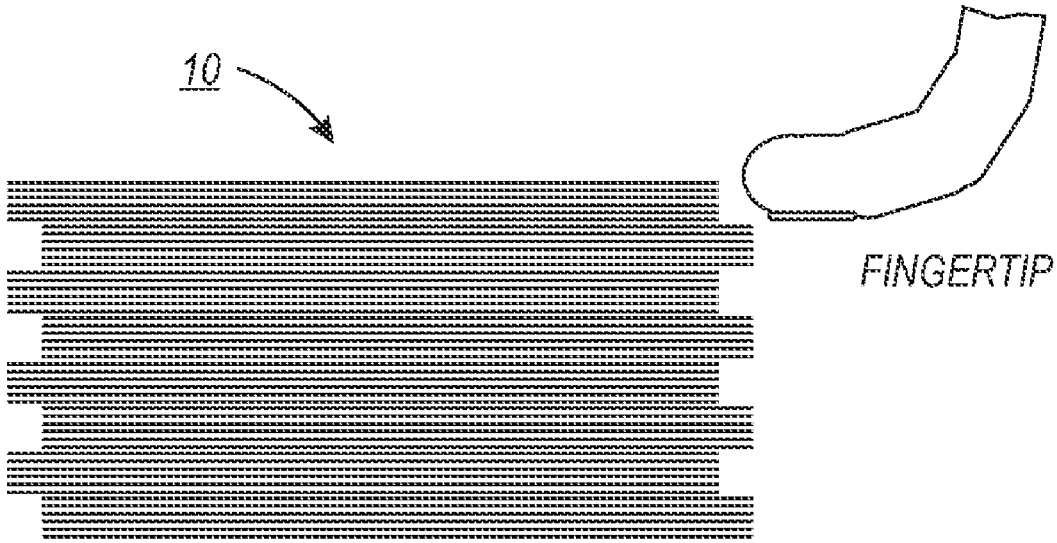
FIG. 1 (Prior Art)
FIG. 1 is a frontal view of a typical offset sheet stack.
Figure 2:
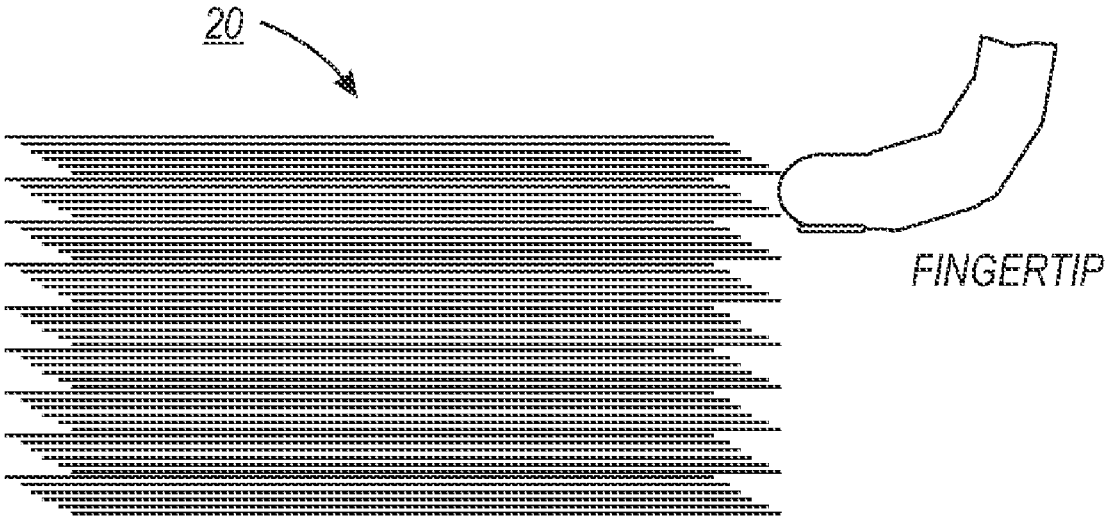
FIG. 2 is a frontal view of progressively offset subsets of imaged sheet subsets of a single print job.

With initial reference to FIG. 1, a prior art copy/subset stack of sheets 10 is shown with a typical jog that alternates the position of the output by a few millimeters for each copy/subset and stacked first sheet face-down. In order to grab or manipulate an individual copy or subset, one would have to grab the bottom edge of the copy or subset on the side that it laps over. As seen in FIG. 1, one cannot grab the top copy/subset with a fingertip on this side since there is no edge to grasp. One would have to move to the other side of the stack to find an edge that can be snagged. However, in accordance with the present disclosure as shown in FIG. 2, a solution this problem includes providing a shingled boundary layer between all subsets of imaged sheets of a single print job within sheet stack 20, with the top sheet of all subsets in the same position, but with the rest of the remaining imaged sheets of each subset progressively offset from the sheet below it so that the last page of the upper subset is significantly offset from the top sheet of the subset below it. The progressive offset is continuous and presents an offset profile in a sawtooth or stair-step fashion in order to add strength and rigidity to each subset so that wrinkling of individual sheets is not a problem when each subset is lifted. With the sawtooth jog, each successive graduation will reinforce the one before it. A single print job being defined as a collection of one or more documents transmitted to a digital printing device at one time, processed by that device as a single, identifiable unit, not considered complete until every part of it is printed in its entirety, whose output consists of an individual stack of printed pages and a subset of a print job being defined as a grouping of printed output that are not copies within a print job that is useful to separate (by shingling) in a discrete fashion from other parts of the print job, such as, individual documents in a single-copy, multi-document job or groups of collated copies of a multi-document job. This creates a sawtooth jog to each copy or subset which leaves an edge one can snag with a finger as shown for each copy or subset on the same side of the stack of sheet subsets produced for a single predetermined job. That is, a shingled boundary is produced between each subset of imaged sheets of a single print job that includes a protruding edge which is reinforced by a progressively shingled edge of each sheet above it that covers a major portion of the sheet that includes the protruding edge in order to add strength to the protruding edge and inhibit wrinkling of the protruding edge when each subset is lifted.

Figure 3:
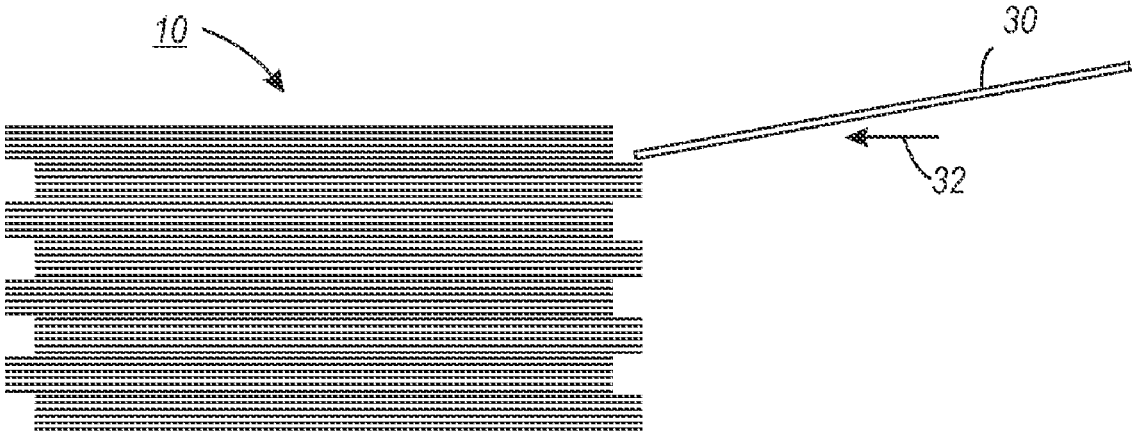
FIG. 3 (Prior Art)
FIG. 3 is a frontal view of a typical offset sheet stack showing the insertion of a tab into a subset of the stack.
Figure 4:
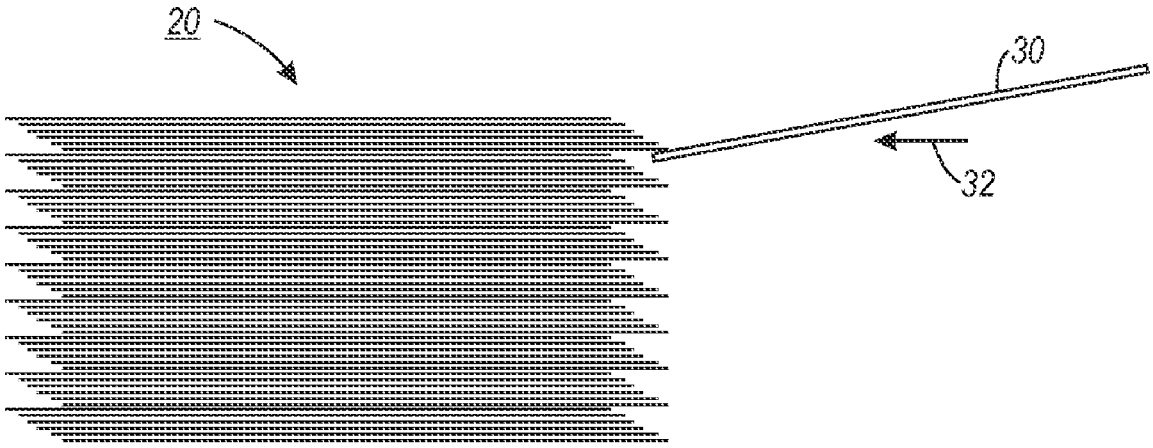
FIG. 4 is a frontal view of progressively offset of imaged sheet subsets of a single print job showing the insertion of a tab into a subset of the stack.

FIG. 3 shows a conventional offset stacking of copy or subsets of sheets 10 and it can be seen that inserting a tab or divider 30 manually into the stack in the direction of arrow 32 can be very difficult. Only on every other copy/subset is there an edge one can snag in order to place a tab page under the individual subset. In FIG. 4, insertion of tabs or other stock 30 in the direction of arrow 32 under a subset is made easier by creating a sawtooth edge to each copy or subset with the top sheet of each subset in the same position and the remainder of each subset being progressively offset. As a result, the last page of the upper subset is offset from the top sheet of the next subset and thereby facilitating the separating of subsets from one side more easily and pages can be manually inserted with ease.

It should now be known that a method which, for example, could be incorporated in a print driver setting or at a multifunction device user interface, has been disclosed that enables a sawtooth shaped offset for multiple set stacks and thereby provides an ease of insertion of tabs or other stock into individual subsets of a stack of sheets. The sawtooth jog of each subset of the stack positions the last page of the upper set significantly offset from the first page or top sheet of the next set making the upper set quite accessible to lifting by one for placing a divider sheet between the last page of the upper and the first page or top sheet of the next set. Additionally, the sawtooth shaped offset of the subsets enhances one's ability to pick individual subsets away from a stack of subsets.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for facilitating easy insertion of dividers between imaged sheet subsets of a sheet stack, comprising:

a) providing a stack of imaged sheet subsets with each subset including multiple sheets of a single print job;

b) creating a shingled boundary between each sheet of a subset of said imaged sheets such that the top sheets of all subsets are in the same position and the remaining sheets in each subset progressively offset so that a last page of an upper subset is offset from a top page of a next subset; and grasping said protruding edge of a subset of the sheet stack and lifting said protruding edge and placing a divider sheet between said protruding edge and a top sheet of the next subset of imaged sheets.

2. The method of claim 1, wherein said shingled boundary between each subset of imaged sheets includes a protruding edge that is reinforced by said progressive offset of each sheet above it.

3. The method of claim 2, including positioning said protruding edge of each subset of imaged sheets on the same side of the sheet stack.

4. The method of claim 1, including providing said shingled boundary between each subset of imaged sheets in a sawtooth configuration.

* * * * *